US009364733B2

(12) United States Patent
Esposito

(10) Patent No.: US 9,364,733 B2
(45) Date of Patent: Jun. 14, 2016

(54) TOSS GAME AND METHODS THEREOF

(71) Applicant: Anthony J. Esposito, Sparta, NJ (US)

(72) Inventor: Anthony J. Esposito, Sparta, NJ (US)

( * ) Notice: Subject to any disclaimer, the term of this patent is extended or adjusted under 35 U.S.C. 154(b) by 152 days.

(21) Appl. No.: 13/844,871

(22) Filed: Mar. 16, 2013

(65) Prior Publication Data

US 2014/0265138 A1 Sep. 18, 2014

(51) Int. Cl.

| | |
|---|---|
| ***A63B 63/00*** | (2006.01) |
| ***A63B 67/06*** | (2006.01) |
| ***A63B 71/06*** | (2006.01) |
| *A63B 71/02* | (2006.01) |

(52) U.S. Cl.

CPC ..... *A63B 67/06* (2013.01); *A63B 71/0669* (2013.01); *A63B 63/00* (2013.01); *A63B 2071/026* (2013.01)

(58) Field of Classification Search

CPC ..... A63B 63/08; A63B 63/00; A63B 67/06; A63B 67/002; A63B 2067/063; A63F 2250/024; A63F 9/0204; A63F 9/02

USPC ..... 273/398–402

See application file for complete search history.

(56) References Cited

U.S. PATENT DOCUMENTS

| | | | | | |
|---|---|---|---|---|---|
| 1,211,379 | A * | 1/1917 | Maisch | 273/368 |
| 1,542,063 | A * | 6/1925 | Knight | 273/399 |
| 1,996,986 | A * | 4/1935 | Weinberg | 273/400 |
| 2,183,107 | A * | 12/1939 | Savage | 273/400 |
| 2,224,962 | A * | 12/1940 | Hines | 273/400 |
| 2,455,185 | A * | 11/1948 | May | 473/195 |
| 3,820,789 | A * | 6/1974 | Dudley | 273/400 |
| 4,898,392 | A * | 2/1990 | Goletz | 273/336 |
| 5,178,356 | A * | 1/1993 | Schouwey | 248/519 |
| 5,462,286 | A * | 10/1995 | Roberts | 273/459 |
| 5,516,114 | A * | 5/1996 | Michlin et al. | 273/400 |
| 8,651,492 | B1 * | 2/2014 | Cappuccio | 273/348 |
| 2008/0252017 | A1 * | 10/2008 | Rowan | 273/400 |
| 2010/0140873 | A1 * | 6/2010 | Britton et al. | 273/398 |
| 2012/0169012 | A1 * | 7/2012 | Parker et al. | 273/400 |
| 2013/0033004 | A1 * | 2/2013 | Van Ness | 273/357 |
| 2014/0183823 | A1 * | 7/2014 | Deming et al. | 273/371 |
| 2014/0265136 | A1 * | 9/2014 | Parker et al. | 273/398 |

* cited by examiner

*Primary Examiner* — Mark Graham
(74) *Attorney, Agent, or Firm* — Michael P. Kochka, Esq.

(57) ABSTRACT

Embodiments of the present disclosure generally relate to a toss game. In one embodiment of the present disclosure, a toss game is provided that may comprise a toss object; a vertical support having a top portion and a bottom portion, the bottom portion adapted to support the vertical support in a vertical position; and a first receptacle disposed on the vertical support, the receptacle having a first game score value and adapted to receive the toss object and allow the toss object to come to rest within the receptacle; and a second receptacle disposed on the vertical support, the second receptacle having a second game score value and adapted to receive the toss object.

18 Claims, 4 Drawing Sheets

TOSS GAME AND METHODS THEREOF

BACKGROUND

1. Field of the Invention

Embodiments of the present disclosure generally relate to a toss game. More specifically, embodiments of the present disclosure relate to a toss game that may comprise a toss object, a vertical support, and receptacles attached to the vertical support adapted to receive the toss object.

2. Description of the Related Art

Recently, toss games have increased in popularity. Games such as BoloToss®, bean bag toss, horseshoes, have become popular in recent years. These games are often played at social gatherings on beaches and in parking lots during "tailgate" parties. With the increase in popularity of toss games, the need to transport these games has increased. Many of toss games are not easily transportable, however, because they are bulky and contain small parts that are easily misplaced. In addition, many of these games have been in existence for a number of years, and the excitement of playing these games has worn off for many players. Thus, there is a need for an improved toss game that may comprise easily transported parts.

SUMMARY

Embodiments of the present disclosure generally relate to a toss game. More specifically, embodiments of the present disclosure relate to a toss game that may comprise a toss object, a vertical support, and receptacles attached to the vertical support adapted to receive the toss object.

In one embodiment of the present disclosure, a toss game is provided that may comprise a toss object; a vertical support having a top portion and a bottom portion, the bottom portion adapted to support the vertical support in a vertical position; and a first receptacle disposed on the vertical support, the receptacle having a first game score value and adapted to receive the toss object and allow the toss object to come to rest within the receptacle; and a second receptacle disposed on the vertical support, the second receptacle having a second game score value and adapted to receive the toss object and allow the toss object to come to rest within the second receptacle.

In another embodiment of the present disclosure, a toss game is provided that may comprise a toss object; a vertical support having a top portion and a bottom portion; a receptacle disposed on the vertical support, the receptacle adapted to receive the toss object; and a base adapted to receive the bottom portion of the vertical support and support the vertical support in a substantially vertical position.

In yet another embodiment of the present disclosure, a method of playing a game is provided that may comprise providing a toss game comprising a toss object; a vertical support having a top portion and a bottom portion, the bottom portion adapted to support the vertical support in a vertical position; and a receptacle having a game score value, the receptacle disposed on the vertical support and adapted to receive the toss object and allow the toss object to come to rest within the receptacle; placing the bottom portion of the vertical support within a floor surface thereby securing the vertical support in a vertical position; measuring a predetermined distance from the vertical support; tossing the toss object from the predetermined distance and landing the toss object in the receptacle; adding the game score value of the receptacle to a total score value, thereby determining a new total score value; ending the game when the new total score value exceeds a threshold amount.

BRIEF DESCRIPTION OF THE DRAWINGS

So the manner in which the above recited features of the present disclosure can be understood in detail, a more particular description of embodiments of the present disclosure, briefly summarized above, may be had by reference to embodiments, which are illustrated in the appended drawings. It is to be noted, however, the appended drawings illustrate only typical embodiments of embodiments encompassed within the scope of the present disclosure, and, therefore, are not to be considered limiting, for the present disclosure may admit to other equally effective embodiments, wherein.

Figure 1A:
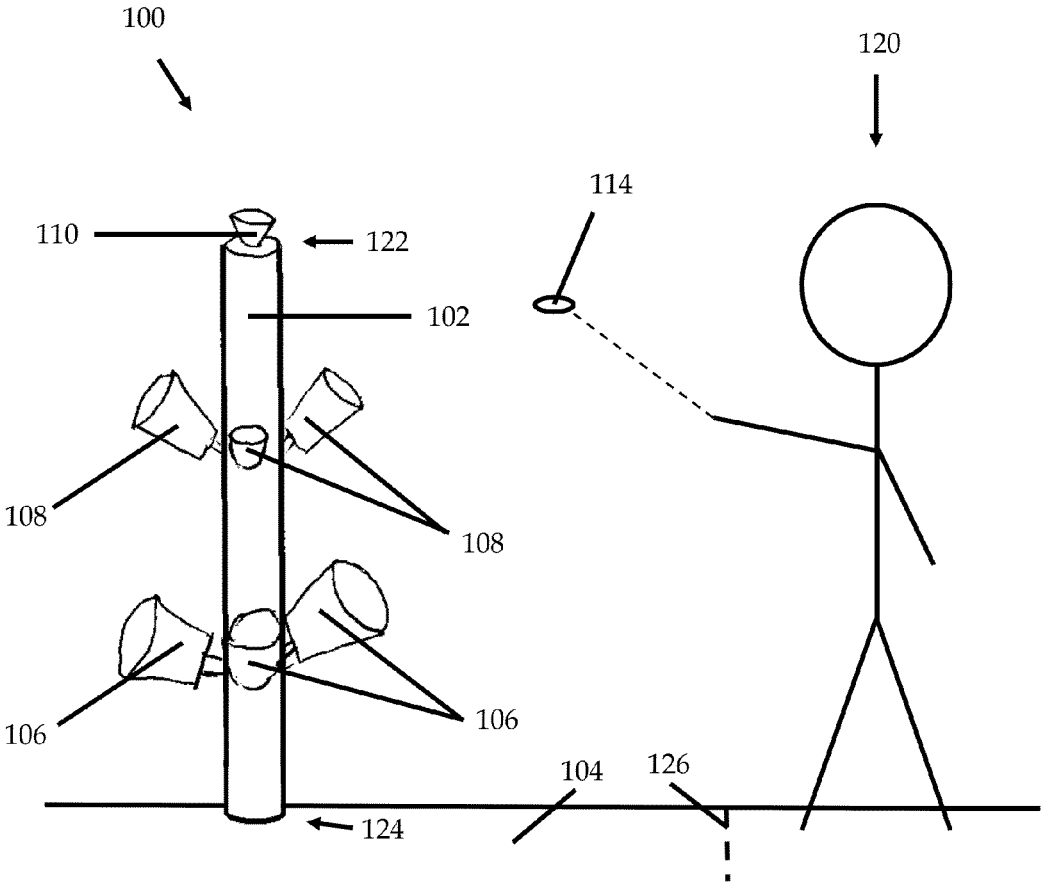
FIGS. 1A and 1B depict a front view and a top view, respectively, of a toss game and a user in accordance with embodiments of the present disclosure.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present disclosure generally relate to a toss game. More specifically, embodiments of the present disclosure relate to a toss game that may comprise a toss object, a vertical support, and receptacles attached to the vertical support adapted to receive a toss object.

Figure 1B:
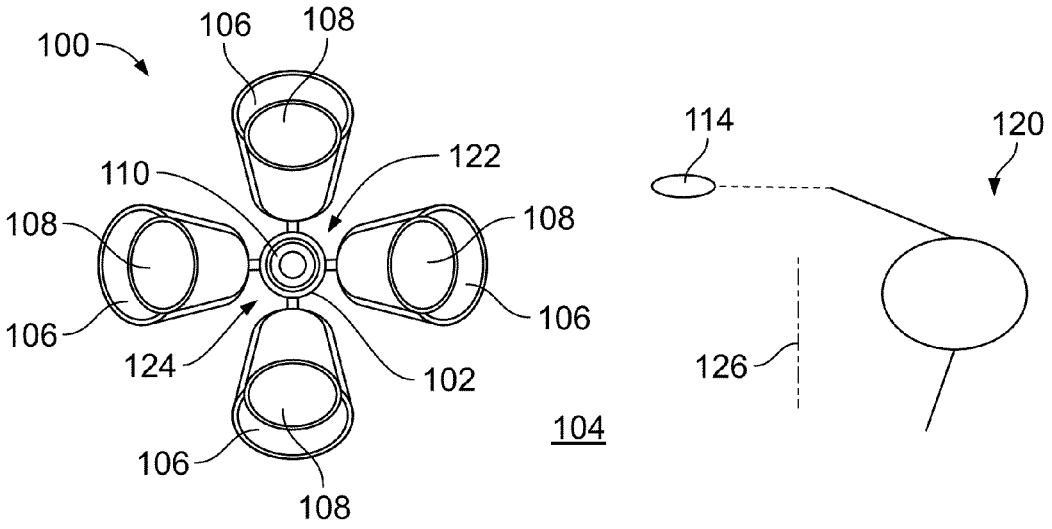

FIGS. 1A and 1B depict a front view and a top view, respectively, of a toss game 100 in accordance with embodiments of the present disclosure. In exemplary embodiments, a toss game 100 may generally comprise a vertical support 102, at least one receptacle 106, 108, 110, and a toss object 114. Although three groups of receptacles 106, 108, and 110 are depicted, any number of receptacles and/or groups of receptacles consistent with the present disclosure is contemplated. The receptacles 106, 108, 110 may be adapted to attach to the vertical support 102. The vertical support 102 may be adapted to support the receptacles 106, 108, 110.

To set-up the game, the vertical support 102 may be installed on or within a floor surface 104 so that the vertical support 102 is supported in a vertical position substantially perpendicular to the floor surface 104, and a player 120 may move to a tossing position. To play the game, a player 120 may toss the toss object 104 in an attempt to land the toss object 104 within a receptacle 106, 108, 110 to score a number of points. The player 120 may receive points if the toss object 104 comes to rest within a receptacle 106, 108, 110, and does not otherwise bounce out or the like. The player 120 may be required to stand a predetermined distance away from the vertical support 102. For example, the player 120 may be required to stand five feet, ten feet, fifteen feet, and/or the like away from the vertical support 102. In some examples, the rules may be different for different age groups. For example, for children younger than 10 years old, the required distance a player must stand away from the vertical support 102 may comprise 3 feet, and for those 10 years old or older, the required distance may comprise 6 feet. In some embodiments, the player 120 may choose one of a set of predetermined distances, wherein higher point totals may be awarded for tosses from longer predetermined distances. In some embodiments, a foul line 126 may be established at a predetermined distance, so that if a player 120 steps on or over the foul line the player's point total will not count for that toss and/or the player 120 may lose a turn. The foul line 126 may be simply drawn as an indentation in the floor surface 104 or may be a physical divider that is laid on top of the floor surface 104. For example, the foul line 126 may comprise a string, a strip of plastic, a chain, and/or the like.

In exemplary embodiments, the players 120 may play in teams. The game 100 may be played with one or more players 120 with the object of reaching a threshold point total. When more than one player 120 plays the game, competing players 120 may be given turns to toss the toss object 114. A turn may comprise a single toss, or a set of tosses, and competing players 120 may alternate turns. When the threshold point total is reached, the game 100 may be over and the player 120 reaching the threshold point total first. For example, if the threshold point total is 21 points, the first player 120 to reach a total of 21 points may win the game.

In some embodiments, when one player 120 reaches the threshold point total, the competing players may be given one more turn to reach the threshold point total to force a tie-breaker. If the competing players fail to reach the threshold point total, the game may be over and the first player to reach the threshold point total may win. If a tie-breaker is reached, a second round of turns may commence, wherein the object may be to reach a second threshold point total. For example, a tie-breaker round may have a second threshold point total of 5 points. When the second threshold point total is reached, the first player to reach the total may win the game, or the competing players may be given a chance to tie the game and force a second tie-breaker round. Any number of tie-breaker rounds may be played until a tie-breaker is not forced and a winner is established. In some embodiments, when the toss object 114 lands and comes to rest within a predetermined receptacle, the game may automatically be over and the tossing player may win. For example, if a player 120 lands the toss object 114 in receptacle 110, the game may be over and the tossing player may win. In some embodiments, when the toss object 114 lands and comes to rest within a predetermined receptacle, a player 120 may lose points or may automatically lose the game.

In some embodiments, if the toss object 114 fails to come to rest within any receptacle 106, 108, 110, the tossing player 120 may lose points. In some embodiments, when a player 120 makes a predetermined number of tosses without successfully landing a toss object 114 within a receptacle 106, 108, 110, the player may lose points or automatically lose the game. For example, if a player 120 makes 10 unsuccessful tosses, the player may lose 5 points or automatically lose the game. In some embodiments, the method of tossing the toss object 114 may be regulated. By way of example, players 120 may be required to toss the toss object underhand, overhand, sidearm, or the like, or otherwise lose a turn. The score may generally be kept manually. The toss game 110 may comprise a score keeping member (not shown) for manually keeping the score. For example, an abacus-type score keeping member may be used. In some embodiments, a digital score calculator (not shown) may be included for tabulating the score. For example, a digital score calculator (not shown) may comprise a device for detecting points have been scored, such as a weight detector or a surface contact detector, and may automatically tabulate and display the scores on a digital display. In some embodiments, the toss object 114 may comprise a chip and the receptacles 106, 108, 110 may recognize the presence of the chip within the receptacles 106, 108, 110 and the digital score calculator may be notified and automatically calculate point totals.

In exemplary embodiments, the receptacles 106, 108, 110 may comprise different sizes and point values/game score values may be assigned to each receptacle 106, 108, 110 and/or group of receptacles. Because it may be easier for the player 120 to land the toss object 104 in a larger receptacle, the smaller receptacles may be assigned higher point values/game score values than the larger receptacles. By way of example, the toss game 100 may comprise a first small-sized receptacle or group of receptacles 110, which may be assigned the value of 10 points; a second larger-sized receptacle or group of receptacles 108, which may be assigned the value of 7 points; and an third even larger receptacle or group of receptacles 106, which may be assigned the value of 5 points. The toss game 100 may comprise more than one receptacle having the same point value/game score value. By way of example, the game 100 may comprise one first receptacle 110, three second receptacles 108, and three third receptacles 106. All combinations of numbers of receptacles and/or sets of receptacles 106, 108, 110 suitable for use with embodiments of the present disclosure are contemplated.

The receptacles 106, 108, 110 may be shaped and adapted to receive a toss object 104. For example, the receptacles 106, 108, 110 may be shaped in a cup-like shape and/or be shaped differently, such as in the shape of seashells, animals, half-spheres, and/or the like. The receptacles and/or group of receptacles 106, 108, 110 may comprise any shape consistent with the present disclosure. Different groups of receptacles 106, 108, 110 may comprise the same shape or different shapes. For example, the receptacles 106, 108, 110 may comprise the shape of a cup or a portion of a cup, such as a bisected cup. The receptacles 106, 108, 110 may comprise an aperture adapted to receive the toss object 114 and a collection base adapted to allow the toss object 114 to come to rest within the collection base. The aperture in the receptacles 106, 108, 110 may comprise any shape consistent with embodiments of the present disclosure. The receptacles 106, 108, 110 may comprise a material capable of supporting the weight of a toss object 114 and/or resisting breaking when struck with a toss object 114. For example, the receptacles 106, 108, 110 may comprise plastic, foam, wood, metal, glass, paper, and/or the like. The receptacles 106, 108, 110 may be any color and/or adapted to receive text, writing, an image, and/or the like. In some embodiments, the receptacles 106, 108, 110, the vertical support 102, and/or the toss object 114 may comprise a surface capable of accepting erasable writing. By way of example, the receptacles 106, 108, 110, the vertical support 102, and/or the toss object 114 may comprise a dry-erase surface, a chalkboard surface, and/or the like.

The receptacles 106, 108, 110 may be attached to the vertical support 102. In some embodiments the receptacles 106, 108, 110 may be detachably attached to the vertical support 102. The receptacles 106, 108, 110 may be attached directly to the vertical support 102, or may be attached to the vertical support 102 with an attachment member. The attachment member may comprise a fastener, such as a snap, button, hook and loop set, adhesive, zipper, and/or the like. The attachment means may also comprise a support extending from a portion the vertical support 102. For example, the support may comprise a dowel, a rod, and/or the like. If the attachment means comprises a support extending from a portion of the vertical support 102 or the like, the receptacles 106, 108, 110 may be adapted to receive, and couple with, the a portion of the attachment means and become supported. The receptacles 106, 108, 110 may be disposed in any angle consistent with the present disclosure relative to the vertical support 102. By way of example, the receptacles may be placed at any angle range from 0 to 90 degrees in relation to the vertical support 102.

The vertical support 102 may sit on the floor surface 104 and/or may partially penetrate the floor surface 104. In exemplary embodiments, the vertical support 102 may comprise a top portion 122 and a bottom portion 124. The top portion may be adapted to attach to a receptacle 110. The top portion 122 may comprise an aperture (not shown) adapted to accept a toss object 114. Alternatively the top portion 122 may comprise a substantially flat surface without a receptacle attached thereto or an aperture. The bottom portion 124 of the vertical support 102 may be adapted to support the vertical support 102 in a substantially horizontal position. By way of example, the bottom portion 124 of the vertical support 102 may comprise a flat base and/or additional legs or supports (not shown) to keep the vertical support 102 in a vertical position substantially perpendicular to the floor surface 104 while sitting on or near the floor surface 104.

In exemplary embodiments, the floor surface 104 may be substantially flat, and may comprise a material such as blacktop, concrete, gravel, sand, dirt, clay, hardwood floors, carpeted floors, laminate floors, tile floors, and/or the like. The floor surface 104 may also comprise an aperture (not shown) for accepting a portion of the vertical support 102. The floor surface 104 may also be adapted to receive a portion of the vertical support 102 through the floor surface 104. In exemplary embodiments, at least a portion of the bottom portion 124 of the vertical support 102 may be adapted to enter through the floor surface 104 and submerge below the floor surface 104 at a sufficient depth to support the vertical support 102 in a vertical position generally perpendicular to the surface or angled. By way of example, the bottom portion 124 of the vertical support 102 may comprise a substantially pointed end adapted to pierce the floor surface 104 and entering below the floor surface 104 to support the vertical support 102 in a vertical position substantially perpendicular to the floor surface 104. The bottom portion 124 may also comprise an end that is rounded, angled, jagged, or the like, to allow the vertical support 102 to be supported in the floor surface 10.

In some embodiments, a top sleeve (not shown) may be fit over the top portion 112 of the vertical support 102. The top sleeve may be adapted to attach and/or couple with a receptacle 110 or be integral with the receptacle 110. When the game is being set up and the vertical support 102 is ready to be placed through the floor surface 104, the top sleeve may be removed to allow for the user 120 to more easily press the vertical support 120 in a downward direction to pierce the floor surface 104. The top sleeve may comprise any material substantially resilient to wear and tear, such as plastic, metal, stone, wood, and/or the like. In some embodiments, the toss game 100 may also comprise a ground sleeve that may be adapted to pierce the ground on one end and a hollow cavity. The hollow cavity may be adapted to accept the bottom portion 124 of the vertical support 102. When the ground sleeve is used, the bottom portion 124 may be adapted to slide within the ground sleeve. The ground sleeve may be adapted to support the vertical support 102 in a vertical orientation during gameplay. In alternative embodiments, the bottom portion 124 may be substantially flat but may have thin edges adapted to allow a portion of the vertical support 102 to pierce the floor surface 104 and become partially submerged under the floor surface 104.

In exemplary embodiments, the vertical support 102 may comprise one piece or may be comprise two or more pieces that couple together. For example, the vertical support 102 may include two pieces that frictionally fit together, clip together, snap together with straps, and/or the like. The vertical support 102 may comprise any height consistent for use with the game 100 of the present disclosure. By way of example the vertical support 102 may comprise a height in the range of 1 foot to 12 feet. The vertical support 102 may be height adjustable. For example, the vertical support 102 may comprise a telescoping cylinder and/or separate pieces that may be removed for height adjustment. The vertical support 102 may comprise any material consistent with embodiments of the present disclosure. For example, the vertical support may comprise plastic, PVC, wood, stone, foam, synthetic material, natural material, and/or the like. The material may be generally adapted to support any number of receptacles 106, 108, 110 and/or toss objects 114 consistent with the present disclosure and resist breaking when struck with a toss object 114 tossed by a player 120. In alternative embodiments, the vertical support 102 may comprise integral receptacles (not shown) formed in the surface of the vertical support 102. The vertical support may also comprise apertures (not shown) that connect to a hollow channel in the vertical support, wherein a toss object 114 may enter the hollow channel after passing through the apertures. The shape of the hollow channel may direct the toss object 114 to the bottom of the vertical support 102 or another location for ease of collection.

In exemplary embodiments, a toss object 114 may comprise an object capable of landing and coming to rest within a receptacle 106, 108, 110 after being tossed by a user 120. By way of example, a toss object 114 may comprise a seashell, a beer cap, a button, a coin, a piece of plastic, a washer, and/or the like. For example, the game 100 may comprise a set of seashells for use as toss objects 114. Any number of toss objects consistent with the present disclosure is contemplated. For example, 2, 3, 4, 6, and 8, toss objects, or the like, may be used. In some embodiments, if a user 120 forgets the toss object 114 and does not bring the toss object 114 to the location where the game is to be played, a substitute toss object comprising objects the user finds at the location may be used. For example, seashells on a beach, pebbles on the grown, twigs, or the like may be used as toss objects 114. In addition, objects that a user 120 may bring with them or carry with them to the location may be used as toss objects 114, such as beer caps, pen caps, buttons, and/or the like. In some embodiments, more than one toss object 114 may be used. For example, buttons and seashells may be used. In some embodiments, a specific point total, bonus total, or multiplier may be added for use of a specific toss object 114 that is more difficult to toss and/or land in a receptacle 106, 108, 110 than other toss objects 114. A toss object 114 may generally comprise a shape that may be capable of allowing the toss object 114 to come to rest within a receptacle 106, 108, 110 after being tossed by a user 120. For example, the toss object 114 may be round, oval, square, and/or the like. A toss object 114 may comprise a weight that may allow the toss object 114 to strike the vertical support 102 and/or the receptacles 106, 108, 110 after being tossed by a player 120 and substantially resist breaking, chipping, and/or cracking the toss object 114, the support 102, and/or the receptacles 106, 108, 110. Each player 120 may be supplied with a number of toss objects 114. Two or more groups of toss objects 114 may comprise different colors, text, images, logos, and/or patterns to distinguish toss objects 114 tossed by different players 120.

Figure 2:
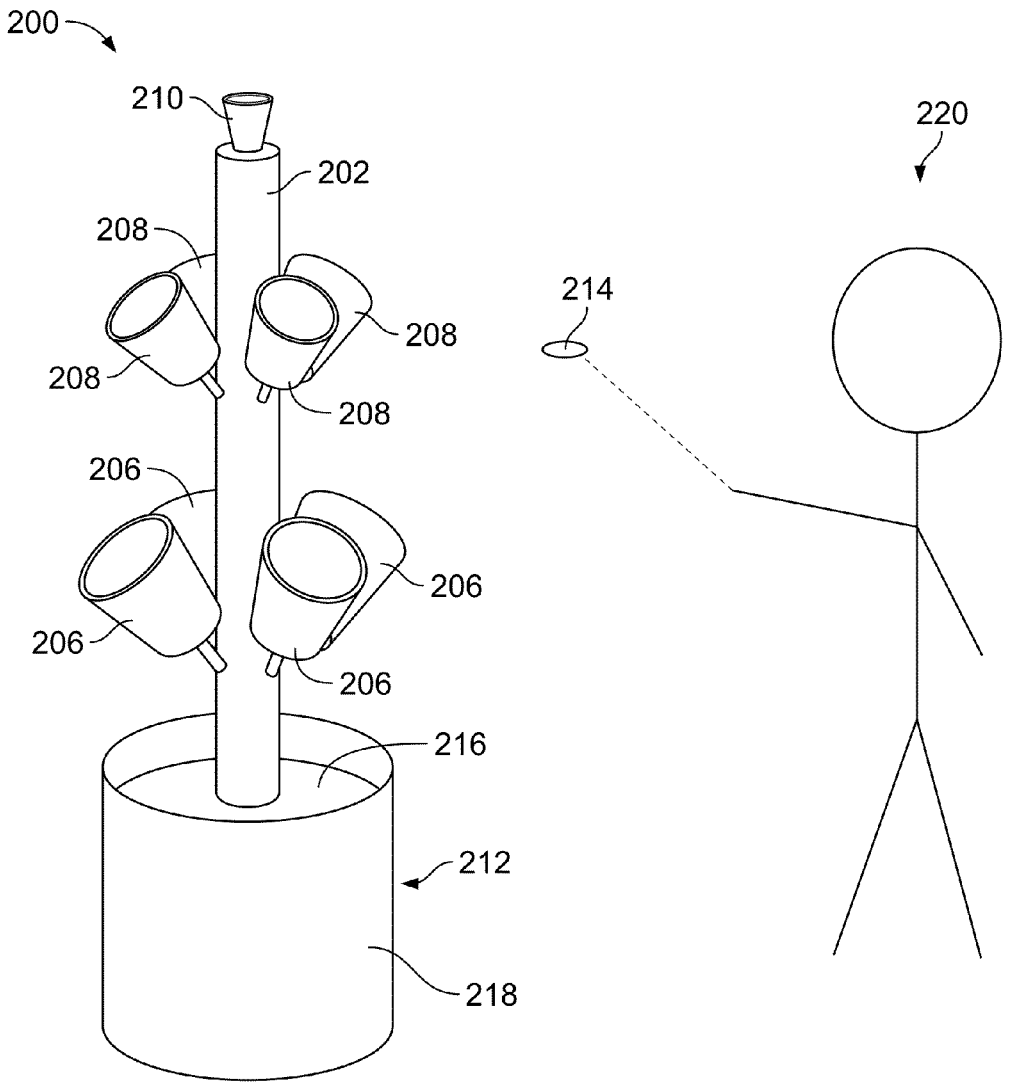
FIG. 2 depicts a front view of a toss game and a user in accordance with embodiments of the present disclosure.

Referring now to FIG. 2, a front view of a toss game 200 and a user 220 in accordance with embodiments of the present disclosure is depicted. The toss game 200, vertical support 202, receptacles 206, 208, 210, toss object 214, and player 220 may be the same as the toss game 100, vertical support 102, receptacles 106, 108, 110, toss object 114, and player 120 described with respect to FIGS. 1A and 1B, respectively. In addition, in some embodiments, the toss game 200 may further comprise a base 212 adapted to receive the vertical support 202. The base 212 may be a single piece with an aperture formed therein for accepting a portion of the vertical support 202 and supporting the vertical support 202 in a vertical position. In exemplary embodiments, the base 212 may comprise a container 218 and a material 216 within the base 212 adapted to accept a portion of the vertical support 202 and support the vertical support 202 in a vertical position. For example, the base 212 may comprise a bucket and/or container 218 and the material 216 may comprise sand, gravel, dirt, clay and/or the like. The base 212 may comprise a weight capable of being transported by a player 220. The base 212 may generally allow players 220 to play the game in an indoor environment or on a surface that may not be penetrated by the vertical support 202 and/or does not contain an aperture.

Figure 3:
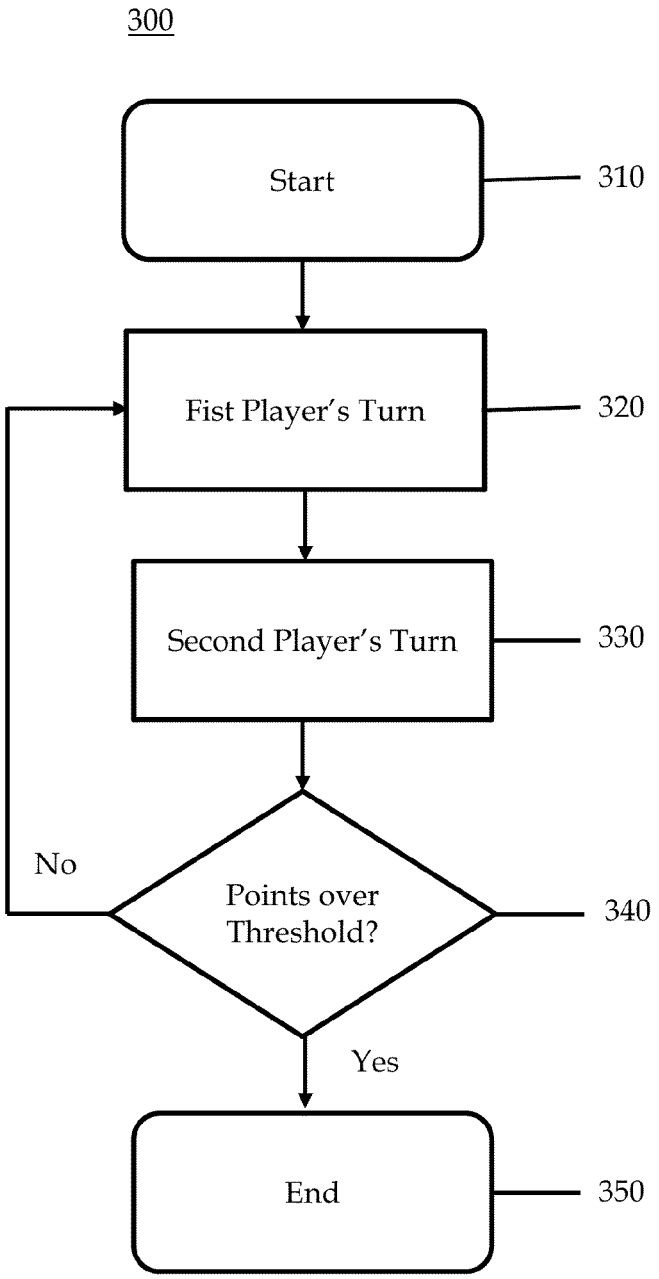
FIG. 3 depicts a flowchart of a method of playing a toss game in accordance with embodiments of the present disclosure.

FIG. 3 depicts a flowchart of a method of playing a toss game in accordance with embodiments of the present disclosure. In accordance with embodiments of the present disclosure, a toss game, such as the examples disclosed herein with respect to FIGS. 1 and 2 is provided and set-up for gameplay at step 310, where the method may begin. In embodiments, such a toss game may generally comprise a vertical support, one or more receptacles, and a toss object. For convenience, the method 300 of FIG. 3 is described with reference to the toss game 100 and player 120 described hereinabove with respect to FIGS. 1A and 1B. The method 300 may be carried out using other embodiments as well. For ease, the method 300 is described as a two-player game, however any number of players and/or teams consistent with embodiments of the present disclosure is contemplated, and additional steps may be added in the method of playing the toss game 100 accordingly.

At step 320, a first player may begin playing the game by tossing a toss object 114 and attempting to land the toss object 114 in a receptacle 106, 108, 110. If the toss object 114 lands in a receptacle, the first player is awarded the points associated with that receptacle. If the toss object 114 fails to land within a receptacle 106, 108, 110, no points are awarded, and the turn advances to a second player at step 330. In some embodiments, players may be allowed several tosses within a single turn. In exemplary embodiments, a turn is described hereinabove with respect to the description of FIGS. 1A and 1B. The second player's turn at step 330 may be governed under the same rules as the first player's turn at step 320. The second player's turn 320 is described hereinabove with respect to the description of FIGS. 1A and 1B. After the second player's turn 330 is completed a determination is made of whether either player has been awarded a total amount of points over a predetermined threshold at step 340.

At step 340, if either player's point total exceeds the predetermined threshold, the game may advance to step 350 where the game may be over and a winner declared in accordance with embodiments of the present disclosure. In some embodiments, the competing player that has not yet reached the threshold may be given one final turn to attempt to collect points to exceed the threshold. In this final turn, if the other player successfully collects points that exceed the threshold, a tie-breaker procedure may be instituted, which is described hereinabove with respect to the description of FIGS. 1A and 1B. If neither player's point total exceeds the threshold, the method may return to step 320 where the first player is given another turn. In some embodiments, the players may be required to switch tossing positions and/or locations after each round of turns. After a winner is established in accordance with the rules described hereinabove with respect to the description of FIGS. 1A and 1B, the game advances to step 350 and a player and/or team is declared the winner. In some embodiments, games may be played in series such as the best out of three, five, or seven games. For example, in a best out of three series, the first player and/or team to win two games would be declared the winner.

It should be emphasized that the above-described embodiments of the present disclosure are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

Now that exemplary embodiments of the present disclosure have been shown and described in detail, various modifications and improvements thereon will become readily apparent to those skilled in the art.

It will be understood that one or more of the steps described can be rearranged, separated, and/or combined without deviating from the scope of embodiments of the disclosure. For ease, steps are, at times, presented sequentially. This is merely for ease and is in no way meant to be a limitation.

Further, it will be understood that one or more of the elements and/or exemplary embodiments of the disclosure described can be rearranged, separated, and/or combined without deviated from the scope of the disclosure. For ease, various elements are described, at times, separately. This is merely for ease and is in no way meant to be a limitation.

While the various steps, elements, and/or exemplary embodiments of the disclosure have been outlined above, it is evident that many alternatives, modifications and variations will be apparent to those skilled in the art. The various steps, elements, and/or exemplary embodiments of the disclosure, as set forth above, are intended to be illustrative, not limiting. Various changes can be made without departing from the spirit and scope of the disclosure. Accordingly, the spirit and scope of the present disclosure is to be construed broadly and not limited by the foregoing specification.

No element, act, or instruction used in the description of the present application should be construed as critical or essential to the disclosure unless explicitly described as such. Also, as used herein, the article "a" is intended to include one or more items. Where only one item is intended, the term "one" or similar language is used.

Further, the terms "any of" followed by a listing of a plurality of items and/or a plurality of categories of items, as used herein, are intended to include "any of," "any combination of," "any multiple of," and/or "any combination of multiples of" the items and/or the categories of items, individually or in conjunction with other items and/or other categories of items. In addition, as used herein, the term "set" is intended to include any number of items, including zero. Further, as used herein, the term "number" is intended to include any number, including zero.

What is claimed is:

1. A toss game comprising:

a toss object;

a vertical support having an exterior surface, a first side, a second side, a third side, a fourth side, a top portion, and a bottom portion, the bottom portion adapted to support the vertical support in a vertical position;

a first receptacle disposed on the exterior surface of the vertical support, the receptacle having a cup shape, the receptacle comprising:

an exterior wall defining a collection base for accepting the toss object, wherein no portion of the collection base overlaps a vertical plane formed by the exterior surface the vertical support; and an aperture for receiving the toss object thereby allowing the toss object to come to rest within the collection base, wherein no portion of the aperture overlaps the vertical plane formed by the exterior surface of the vertical support;

a second receptacle disposed on the exterior surface of the vertical support, the second receptacle having a cup shape, the second receptacle comprising:

a second exterior wall defining a second collection base for accepting the toss object, wherein no portion of the second collection base overlaps the vertical plane formed by the exterior surface the vertical support; and a second aperture for receiving the toss object, thereby allowing the toss object to come to rest within the second collection base, wherein no portion of the second aperture overlaps vertical plane formed by the exterior surface of the vertical support;

a third receptacle disposed on the exterior surface of the vertical support, the third receptacle having a cup shape, the third receptacle comprising:

a third exterior wall defining a third collection base for accepting the toss object, wherein no portion of the third collection base overlaps the vertical plane formed by the exterior surface the vertical support; and a third aperture for receiving the toss object thereby allowing the toss object to come to rest within the third collection base, wherein no portion of the third aperture overlaps the vertical plane formed by the exterior surface of the vertical support;

a fourth receptacle disposed on the exterior surface of the vertical support, the fourth receptacle having a cup shape, the fourth receptacle comprising:

a fourth exterior wall defining a fourth collection base for accepting the toss object, wherein no portion of the fourth collection base overlaps the vertical plane formed by the exterior surface the vertical support; and a fourth aperture for receiving the toss object, thereby allowing the toss object to come to rest within the fourth collection base, wherein no portion of the fourth aperture overlaps vertical plane formed by the exterior surface of the vertical support;

a fifth receptacle disposed on the exterior surface of the vertical support, the fifth receptacle having a cup shape, the fifth receptacle comprising:

a fifth exterior wall defining a fifth collection base for accepting the toss object, wherein no portion of the fifth collection base overlaps the vertical plane formed by the exterior surface the vertical support; and a fifth aperture for receiving the toss object thereby allowing the toss object to come to rest within the fifth collection base, wherein no portion of the fifth aperture overlaps the vertical plane formed by the exterior surface of the vertical support;

a sixth receptacle disposed on the exterior surface of the vertical support, the sixth receptacle having a cup shape, the sixth receptacle comprising:

a sixth exterior wall defining a sixth collection base for accepting the toss object, wherein no portion of the sixth collection base overlaps the vertical plane formed by the exterior surface the vertical support; and a sixth aperture for receiving the toss object, thereby allowing the toss object to come to rest within the sixth collection base, wherein no portion of the sixth aperture overlaps vertical plane formed by the exterior surface of the vertical support; and a seventh receptacle disposed on the top portion of the vertical support, the seventh receptacle having a cup shape, the seventh receptacle comprising:

a seventh exterior wall defining a seventh collection base for accepting the toss object, wherein no portion of the seventh collection base overlaps the vertical plane formed by the exterior surface the vertical support; and a seventh aperture for receiving the toss object thereby allowing the toss object to come to rest within the seventh collection base, wherein no portion of the seventh aperture overlaps the vertical plane formed by the exterior surface of the vertical support;

wherein the first receptacle is disposed on the first side of the vertical support and the second receptacle is disposed on the second side of the vertical support, and the first side and the second side are directly opposite each other;

wherein the third receptacle is disposed on the third side of the vertical support at a different height from the first and second receptacles and the fourth receptacle is disposed on the fourth side of the vertical support at a different height from the first and second receptacles, and the third side and the fourth side are directly opposite each other;

wherein the fifth receptacle is disposed on the first side of the vertical support at a different height than the first, second, third, and fourth receptacles and the sixth receptacle is disposed on the second side of the vertical support at a different height than the first, second, third, and fourth receptacles;

wherein the toss game is configured whereby a player may be facing at least three receptacles when the player is facing any side of the vertical support and players may play the game in a circular pattern surrounding the vertical support;

wherein the height of the vertical support is between 50" and 72";

wherein the first and second receptacles are the same size, wherein the third and fourth receptacles are a different size from the first and second receptacles, wherein the fifth and six receptacles are a different size from the first, second, third, and fourth receptacles, and wherein the seventh receptacle is a different size from the first, second, third, fourth, fifth, and sixth receptacles;

wherein the first, second, third, fourth, fifth, and sixth receptacles are angled away from the vertical support;

wherein the seventh receptacle is pointed upwardly on the top surface of the vertical support; and wherein the toss game comprises a collapsible stand, thereby enabling the toss game to be portable.

2. The toss game of claim 1, wherein the toss object comprises at least one of a shell, a bottle cap, a button, and a washer.

3. The toss game of claim 1, wherein the vertical support comprises at least one of plastic, metal, foam, and wood.

4. The toss game of claim 1, wherein at least one receptacle is detachably attached to the vertical support.

5. The toss game of claim 1, wherein at least one receptacle is integral with the vertical support.

6. The toss game of claim 1, wherein the first, second, third, fourth, fifth, and sixth receptacles are disposed on the vertical support between the top portion and the bottom portion.

7. The toss game of claim 1, wherein the bottom portion is adapted to pierce a floor surface and support the vertical support in a vertical position substantially perpendicular to the floor surface.

8. The toss game of claim 7, wherein the floor surface comprises at least one of dirt, gravel, clay, and sand.

9. A toss game comprising:

a toss object;

a vertical support having an exterior surface, a top portion, and a bottom portion;

a receptacle having a cup shape, the receptacle comprising:

an exterior wall defining a collection base for accepting the toss object, wherein no portion of the collection base overlaps a vertical plane formed by the exterior surface the vertical support; and an aperture for receiving the toss object thereby allowing the toss object to come to rest within the collection base, wherein no portion of the aperture overlaps the vertical plane formed by the exterior surface of the vertical support;

a second receptacle disposed on the exterior surface of the vertical support, the second receptacle having a cup shape, the second receptacle comprising:

a second exterior wall defining a second collection base for accepting the toss object, wherein no portion of the second collection base overlaps the vertical plane formed by the exterior surface the vertical support; and a second aperture for receiving the toss object, thereby allowing the toss object to come to rest within the second collection base, wherein no portion of the second aperture overlaps vertical plane formed by the exterior surface of the vertical support;

a third receptacle disposed on the exterior surface of the vertical support, the third receptacle having a cup shape, the third receptacle comprising:

a third exterior wall defining a third collection base for accepting the toss object, wherein no portion of the third collection base overlaps the vertical plane formed by the exterior surface the vertical support; and a third aperture for receiving the toss object thereby allowing the toss object to come to rest within the third collection base, wherein no portion of the third aperture overlaps the vertical plane formed by the exterior surface of the vertical support;

a fourth receptacle disposed on the exterior surface of the vertical support, the fourth receptacle having a cup shape, the fourth receptacle comprising:

a fourth exterior wall defining a fourth collection base for accepting the toss object, wherein no portion of the fourth collection base overlaps the vertical plane formed by the exterior surface the vertical support; and a fourth aperture for receiving the toss object, thereby allowing the toss object to come to rest within the fourth collection base, wherein no portion of the fourth aperture overlaps vertical plane formed by the exterior surface of the vertical support;

a fifth receptacle disposed on the exterior surface of the vertical support, the fifth receptacle having a cup shape, the fifth receptacle comprising:

a fifth exterior wall defining a fifth collection base for accepting the toss object, wherein no portion of the fifth collection base overlaps the vertical plane formed by the exterior surface the vertical support; and a fifth aperture for receiving the toss object thereby allowing the toss object to come to rest within the fifth collection base, wherein no portion of the fifth aperture overlaps the vertical plane formed by the exterior surface of the vertical support;

a sixth receptacle disposed on the exterior surface of the vertical support, the sixth receptacle having a cup shape, the sixth receptacle comprising:

a sixth exterior wall defining a sixth collection base for accepting the toss object, wherein no portion of the sixth collection base overlaps the vertical plane formed by the exterior surface the vertical support; and a sixth aperture for receiving the toss object, thereby allowing the toss object to come to rest within the sixth collection base, wherein no portion of the sixth aperture overlaps vertical plane formed by the exterior surface of the vertical support; and a seventh receptacle disposed on the top portion of the vertical support, the seventh receptacle having a cup shape, the seventh receptacle comprising:

a seventh exterior wall defining a seventh collection base for accepting the toss object, wherein no portion of the seventh collection base overlaps the vertical plane formed by the exterior surface the vertical support; and a seventh aperture for receiving the toss object thereby allowing the toss object to come to rest within the seventh collection base, wherein no portion of the seventh aperture overlaps the vertical plane formed by the exterior surface of the vertical support;

wherein the first receptacle is disposed on the first side of the vertical support and the second receptacle is disposed on the second side of the vertical support, and the first side and the second side are directly opposite each other;

wherein the third receptacle is disposed on the third side of the vertical support at a different height from the first and second receptacles and the fourth receptacle is disposed on the fourth side of the vertical support at a different height from the first and second receptacles, and the third side and the fourth side are directly opposite each other;

wherein the fifth receptacle is disposed on the first side of the vertical support at a different height than the first, second, third, and fourth receptacles and the sixth receptacle is disposed on the second side of the vertical support at a different height than the first, second, third, and fourth receptacles;

wherein the toss game is configured whereby a player may be facing at least three receptacles when the player is facing any side of the vertical support and players may play the game in a circular pattern surrounding the vertical support;

wherein the height of the vertical support is between 50" and 72";

wherein the first and second receptacles are the same size, wherein the third and fourth receptacles are a different size from the first and second receptacles, wherein the fifth and six receptacles are a different size from the first, second, third, and fourth receptacles, and wherein the seventh receptacle is a different size from the first, second, third, fourth, fifth, and sixth receptacles;

wherein the first, second, third, fourth, fifth, and sixth receptacles are angled away from the vertical support;

wherein the seventh receptacle is pointed upwardly on the top surface of the vertical support; and a base adapted to receive the bottom portion of the vertical support and support the vertical support in a substantially vertical position.

10. The toss game of claim 9, wherein the base comprises a single piece with an aperture formed therein adapted to accept the bottom portion of the vertical support.

11. The toss game of claim 9, wherein the base further comprises:

a container; and a material within the container adapted to accept the bottom portion of the vertical support.

12. The toss game of claim 11, wherein the container comprises a bucket.

13. The toss game of claim 11, wherein the material comprises at least one of sand, gravel, clay, and dirt.

14. The toss game of claim 9, wherein at least one receptacle is detachably attached to the vertical support.

15. The toss game of claim 9, wherein at least one receptacle is integral with the vertical support.

16. A method of playing a game comprising:

providing a toss game comprising:

a toss object;

a vertical support having an exterior surface, a top portion, and a bottom portion, the bottom portion adapted to support the vertical support in a vertical position; and a receptacle having a game score value, the receptacle having a cup shape, the receptacle comprising:

an exterior wall defining a collection base for accepting the toss object, wherein no portion of the collection base overlaps a vertical plane formed by the exterior surface the vertical support; and an aperture for receiving the toss object thereby allowing the toss object to come to rest within the collection base, wherein no portion of the aperture overlaps the vertical plane formed by the exterior surface of the vertical support;

a second receptacle disposed on the exterior surface of the vertical support, the second receptacle having a cup shape, the second receptacle comprising:

a second exterior wall defining a second collection base for accepting the toss object, wherein no portion of the second collection base overlaps the vertical plane formed by the exterior surface the vertical support; and a second aperture for receiving the toss object, thereby allowing the toss object to come to rest within the second collection base, wherein no portion of the second aperture overlaps vertical plane formed by the exterior surface of the vertical support;

a third receptacle disposed on the exterior surface of the vertical support, the third receptacle having a cup shape, the third receptacle comprising:

a third exterior wall defining a third collection base for accepting the toss object, wherein no portion of the third collection base overlaps the vertical plane formed by the exterior surface the vertical support; and a third aperture for receiving the toss object thereby allowing the toss object to come to rest within the third collection base, wherein no portion of the third aperture overlaps the vertical plane formed by the exterior surface of the vertical support;

a fourth receptacle disposed on the exterior surface of the vertical support, the fourth receptacle having a cup shape, the fourth receptacle comprising:

a fourth exterior wall defining a fourth collection base for accepting the toss object, wherein no portion of the fourth collection base overlaps the vertical plane formed by the exterior surface the vertical support; and a fourth aperture for receiving the toss object, thereby allowing the toss object to come to rest within the fourth collection base, wherein no portion of the fourth aperture overlaps vertical plane formed by the exterior surface of the vertical support;

a fifth receptacle disposed on the exterior surface of the vertical support, the fifth receptacle having a cup shape, the fifth receptacle comprising:

a fifth exterior wall defining a fifth collection base for accepting the toss object, wherein no portion of the fifth collection base overlaps the vertical plane formed by the exterior surface the vertical support; and a fifth aperture for receiving the toss object thereby allowing the toss object to come to rest within the fifth collection base, wherein no portion of the fifth aperture overlaps the vertical plane formed by the exterior surface of the vertical support;

a sixth receptacle disposed on the exterior surface of the vertical support, the sixth receptacle having a cup shape, the sixth receptacle comprising:

a sixth exterior wall defining a sixth collection base for accepting the toss object, wherein no portion of the sixth collection base overlaps the vertical plane formed by the exterior surface the vertical support; and a sixth aperture for receiving the toss object, thereby allowing the toss object to come to rest within the sixth collection base, wherein no portion of the sixth aperture overlaps vertical plane formed by the exterior surface of the vertical support; and a seventh receptacle disposed on the top portion of the vertical support, the seventh receptacle having a cup shape, the seventh receptacle comprising:

a seventh exterior wall defining a seventh collection base for accepting the toss object, wherein no portion of the seventh collection base overlaps the vertical plane formed by the exterior surface the vertical support; and a seventh aperture for receiving the toss object thereby allowing the toss object to come to rest within the seventh collection base, wherein no portion of the seventh aperture overlaps the vertical plane formed by the exterior surface of the vertical support;

wherein the first receptacle is disposed on the first side of the vertical support and the second receptacle is disposed on the second side of the vertical support, and the first side and the second side are directly opposite each other;

wherein the third receptacle is disposed on the third side of the vertical support at a different height from the first and second receptacles and the fourth receptacle is disposed on the fourth side of the vertical support at a different height from the first and second receptacles, and the third side and the fourth side are directly opposite each other;

wherein the fifth receptacle is disposed on the first side of the vertical support at a different height than the first, second, third, and fourth receptacles and the sixth receptacle is disposed on the second side of the vertical support at a different height than the first, second, third, and fourth receptacles;

wherein the toss game is configured whereby a player may be facing at least three receptacles when the player is facing any side of the vertical support and players may play the game in a circular pattern surrounding the vertical support;

wherein the height of the vertical support is between 50" and 72";

wherein the first and second receptacles are the same size, wherein the third and fourth receptacles are a different size from the first and second receptacles, wherein the fifth and six receptacles are a different size from the first, second, third, and fourth receptacles, and wherein the seventh receptacle is a different size from the first, second, third, fourth, fifth, and sixth receptacles;

wherein the first, second, third, fourth, fifth, and sixth receptacles are angled away from the vertical support;

wherein the seventh receptacle is pointed upwardly on the top surface of the vertical support; and placing the bottom portion of the vertical support within a floor surface thereby securing the vertical support in a vertical position;

measuring a predetermined distance from the vertical support;

tossing the toss object from the predetermined distance and landing the toss object in a receptacle;

adding the game score value of the receptacle to a total score value, thereby determining a new total score value;

ending the game when the new total score value exceeds a threshold amount.

17. The method of claim 16, further comprising:

tossing the toss object from the predetermined distance and landing the toss object in a receptacle a second time when the new total score value does not exceed the threshold amount;

adding the game score value of the receptacle to the new total score value, thereby determining an updated total score value; and ending the game when the updated game score value exceeds the threshold amount.

18. The method of claim 17, wherein the floor surface comprises at least one of sand, gravel, clay and dirt.

* * * * *